US010612508B2

(12) United States Patent
Ginter et al.

(10) Patent No.: US 10,612,508 B2
(45) Date of Patent: Apr. 7, 2020

(54) FUEL INJECTOR FOR INTERNAL COMBUSTION ENGINES

(71) Applicant: Caterpillar Inc., Peoria, IL (US)

(72) Inventors: David Ginter, Peoria, IL (US); Chad Koci, Washington, IL (US); Russell P. Fitzgerald, Peoria, IL (US); Jonathan W. Anders, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 120 days.

(21) Appl. No.: 15/635,360

(22) Filed: Jun. 28, 2017

(65) Prior Publication Data

US 2019/0003438 A1 Jan. 3, 2019

(51) Int. Cl.
*F02M 61/18* (2006.01)
*F02M 61/14* (2006.01)

(52) U.S. Cl.
CPC ..... *F02M 61/1833* (2013.01); *F02M 61/14* (2013.01); *F02M 61/184* (2013.01)

(58) Field of Classification Search
CPC ..... F02M 61/1833; F02M 61/14; F02M 61/1806; F02M 61/184; F02M 61/1846
USPC ..... 123/445; 239/599
See application file for complete search history.

(56) References Cited

U.S. PATENT DOCUMENTS 4,893,754 A * 1/1990 Ruiz ..... B05B 1/04 239/290
5,186,140 A * 2/1993 Ueda ..... F02B 61/02 123/308
6,210,149 B1 * 4/2001 Plavnik ..... F23C 15/00 431/1
6,978,948 B2 * 12/2005 Heinecke ..... F02M 61/1806 239/533.12
9,732,716 B2 * 8/2017 Serizawa ..... F02M 61/184
10,001,101 B2 * 6/2018 Sugiyama ..... F02M 61/184
2001/0017325 A1 * 8/2001 Harata ..... F02M 51/0614 239/533.12
2004/0011890 A1 * 1/2004 Heinecke ..... F02M 61/1806 239/533.2
2004/0163254 A1 * 8/2004 Miyagawa ..... B21D 53/84 29/890.142
2007/0012805 A1 * 1/2007 Maier ..... F02M 51/0671 239/533.12
2008/0073452 A1 * 3/2008 Kuronita ..... F02M 61/182 239/601

(Continued)

FOREIGN PATENT DOCUMENTS

EP 2808533 12/2014
JP 2015200214 11/2015

(Continued)

*Primary Examiner* — David Hamaoui
*Assistant Examiner* — John D Bailey
(74) *Attorney, Agent, or Firm* — Oblon, McClelland, Maier & Neustadt

(57) ABSTRACT

A fuel injector for an internal combustion engine is disclosed. The fuel injector includes a body defining an orifice. The orifice is configured to provide passage to a fuel into a combustion chamber of the internal combustion engine. The orifice includes an inlet port having a first oval shape and an outlet port having a second oval shape. The second al shape is orthogonal to the first oval shape. Moreover, a transition from the first oval shape to the second oval shape defines a stagnation plane, facilitating an exit of the fuel as a fan spray from the outlet port.

16 Claims, 7 Drawing Sheets

(56) References Cited

U.S. PATENT DOCUMENTS

| | | | | |
|---|---|---|---|---|
| 2008/0210199 | A1* | 9/2008 | Zeng | F02M 61/14 123/445 |
| 2009/0272824 | A1* | 11/2009 | Kitagawa | F02M 51/061 239/585.5 |
| 2010/0175668 | A1* | 7/2010 | Chern | F02M 61/14 123/470 |
| 2015/0020778 | A1 | 1/2015 | Upadhye et al. | |
| 2015/0204287 | A1* | 7/2015 | Park | F02M 51/0671 239/585.5 |
| 2015/0345453 | A1* | 12/2015 | Schneider | F02M 61/1833 123/445 |
| 2015/0377202 | A1* | 12/2015 | Ishii | F02M 5/0671 239/584 |
| 2016/0047346 | A1* | 2/2016 | Sugiyama | F02M 61/184 239/584 |
| 2016/0215746 | A1* | 7/2016 | Serizawa | F02M 61/184 |
| 2017/0292489 | A1* | 10/2017 | Noguchi | F02M 51/06 |

FOREIGN PATENT DOCUMENTS

| | | |
|---|---|---|
| WO | 97033086 | 9/1997 |
| WO | 2009055315 | 4/2009 |

* cited by examiner

FUEL INJECTOR FOR INTERNAL COMBUSTION ENGINES

TECHNICAL FIELD

The present disclosure relates generally to fuel injectors for internal combustion engines. More particularly, the disclosure relates to fuel injectors that: deliver a fuel charge in the form of fan spray into a combustion chamber of an internal combustion engine.

BACKGROUND

Modern combustion engines generally include at least one cylinder, a cylinder head for said cylinder, and a piston that may reciprocate within said cylinder. A combustion chamber is defined and delimited by the piston, cylinder, and the cylinder head. Fuel (such as diesel fuel) may be injected by a fuel injector as a fuel charge into the combustion chamber for combustion. Such fuel injectors may include one or more orifices that facilitate the injection of the fuel charge into the combustion chamber.

A manner in which the fuel charge is injected and introduced into the combustion chamber may impact a mixing and/or an interaction of the fuel charge with the air and elements within the combustion chamber. Some injection patterns, for example, may cause overpenetration of the fuel charge and thereby cause an increased interaction of the fuel charge with walls of the cylinder, in turn leading to inadequate mixing of the fuel charge with the air and the elements. As a result, the engine may suffer heat loss, formation of a relatively large amount of soot within the cylinders, and increased emissions.

European Patent No. 2,808,533 ('533 reference) discloses a nozzle body of a fuel injector. The nozzle body includes a spray hole that axially extends throughout a wall of the nozzle body. The '533 reference also discloses that in a vicinity of its entry, an elongated section of the spray hole is oval or elliptical or oblong.

SUMMARY OF THE INVENTION

In one aspect, the present disclosure relates to a fuel injector for an internal combustion engine. The fuel injector includes a body defining an orifice. The orifice is configured to provide passage to a fuel into a combustion chamber of the internal combustion engine. The orifice includes an inlet port and an outlet port. The inlet port includes a first oval shape, while the outlet port includes a second oval shape orthogonal to the first oval shape. A transition from the first oval shape to the second oval shape defines a stagnation plane, facilitating an exit of the fuel as a fan spray from the outlet port.

In another aspect, the disclosure relates to an internal combustion engine. The internal combustion engine includes a combustion chamber defined between a flame deck surface of a cylinder head of the internal combustion engine and a piston crown of a piston disposed within a cylinder bore of the internal combustion engine. Further, the internal combustion engine includes a fuel injector that is configured to inject a fuel into the combustion chamber. The fuel injector includes a body that defines an orifice configured to provide passage to the fuel into the combustion chamber. The orifice includes an inlet port and an outlet port. The inlet port has a first oval shape, while the outlet port has a second oval shape. The second oval shape is orthogonal to the first oval shape. Moreover, a transition from the first oval shape to the second oval shape defines a stagnation plane, facilitating injection of the fuel as a fan spray into the combustion chamber from the outlet port.

DETAILED DESCRIPTION

Reference will now be made in detail to specific embodiments or features of the present disclosure, examples of which are illustrated in the accompanying drawings. Generally, corresponding reference numbers will be used throughout the drawings to refer to the same or corresponding parts. Also, wherever possible, the same reference numbers will be used throughout the drawings to refer to the same, or the like parts.

Figure 1:
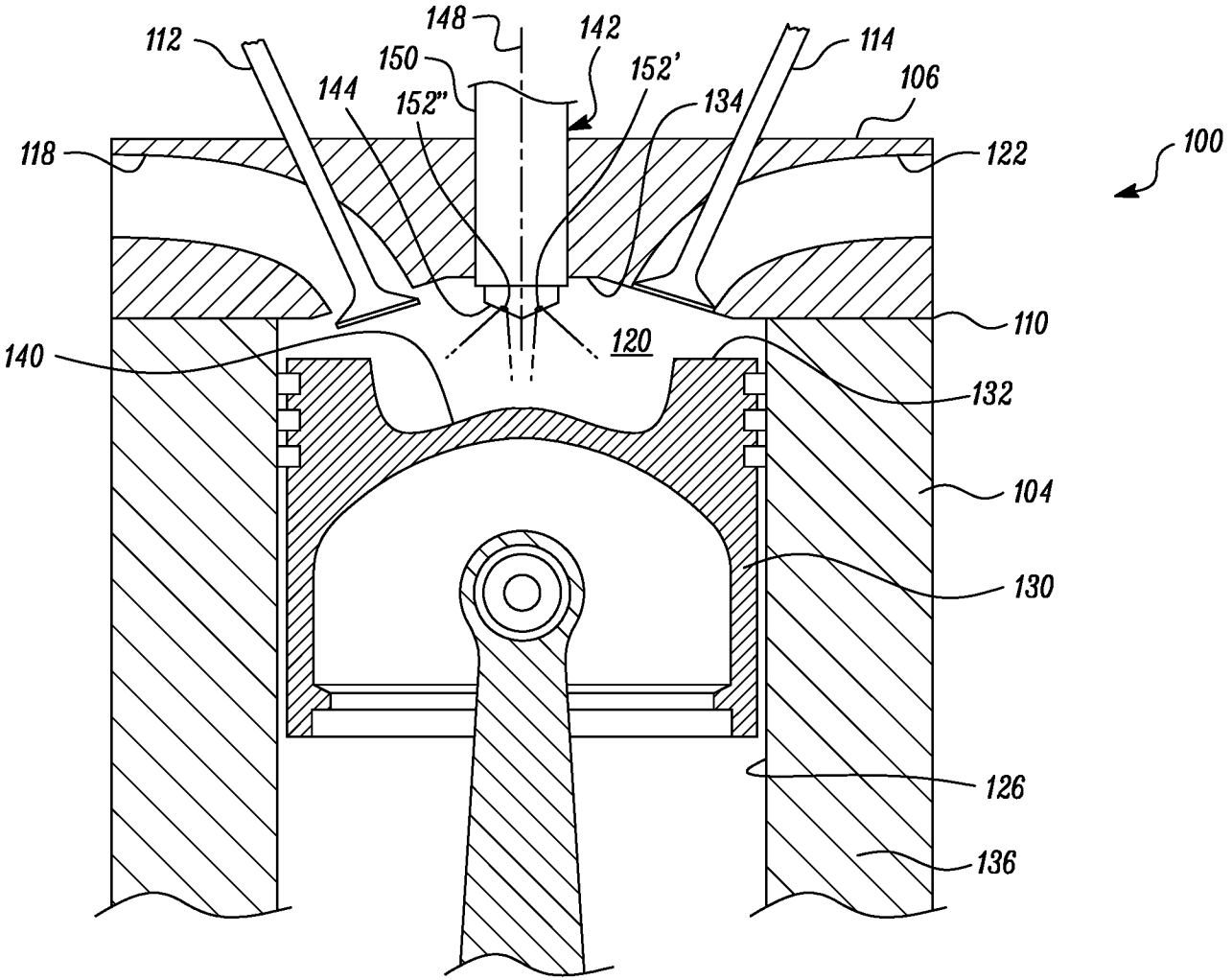
FIG. 1 a diagrammatic view of an internal combustion engine having a fuel injector, in accordance with an embodiment of the disclosure.

Referring to FIG. 1, an exemplary internal combustion engine 100 is shown. The internal combustion engine 100 may be applied in a variety of machines, such as, but not limited to, trucks, locomotives, ships, and construction machines. Construction machines may include excavators, loaders, dozers, scrapers, forest machines, cold planers, pavers, etc. Moreover, the internal combustion engine 100 may also be applicable to semi-autonomous work machines and autonomous work machines. In some implementations, one or more aspects of the internal combustion engine 100, as described in the present disclosure, may be applied in stationary power generating machines as well. For ease, the internal combustion engine 100 may be simply referred to as engine 100, hereinafter.

The engine 100 may be a reciprocating engine and may embody a diesel engine, a gasoline engine, a gas engine, a two-stroke engine, a four-stroke engine, or any other conventionally known and applied engine. The engine 100 may include a cylinder 104 and a cylinder head 106 arranged at an end 110 of the cylinder 104. The cylinder head 106 may act as a support structure for mounting various components of the engine 100 such as an intake valve 112, an exhaust valve 114, etc., of the engine 100. The cylinder head 106 may include various features such as an intake conduit 118 for allowing intake of a volume of air into a combustion chamber 120 of the engine 100, and an exhaust conduit 122 for facilitating discharge of exhaust gases from the combustion chamber 120, after a cycle of combustion. Further, the cylinder 104 may include a bore 126 extending from the end 110 (referred to as a first end 110) up to a second end (not shown) of the cylinder 104. The engine 100 further includes a piston 130 that is arranged within the bore 126, and is configured to reciprocate within the bore 126 between a top dead center (TDC) of the cylinder 104 and a bottom dead center (BDC) of the cylinder 104. The piston 130 includes a piston crown 132 that is directed against a flame deck surface 134 defined by the cylinder head 106. The combustion chamber 120 may be defined between the flame deck surface 134 of the cylinder head 106 and the piston crown 132, and may be further delimited by a surrounding wall 136 (or a liner wall 136) of the cylinder 104. The piston crown 132 may include a recess 140, as shown, imparting a characteristic shape/profile to the combustion chamber 120, but it will be understood that aspects of the present disclosure are not limited to such shape/profile of the combustion chamber 120, or to a design of the piston crown 132 or recess 140.

The engine 100 may further include a fuel injector 142. The fuel injector 142 may be mounted in the cylinder head 106, and may include a tip 144 that protrudes into the combustion chamber 120 through the flame deck surface 134. In one example, the fuel injector 142 may include a solenoid based mechanism (not shown) to regulate and/or facilitate an injection of a fuel (such as diesel fuel) into the combustion chamber 120. In such an example, the solenoid may generate a magnetic field when supplied with a current or a voltage, and may accordingly cause an operation of a valve, such as a displacement of a needle valve, of the fuel injector 142, in turn opening the fuel injector 142 for fuel injection. When the fuel injector 142 is operated, an injection of a quantity of a pressurized fuel into the combustion chamber 120 may follow. Other known methods of fuel injection may also be contemplated. The fuel injector 142 defines a longitudinal axis 148 defined along a length of the fuel injector 142.

Figure 2:
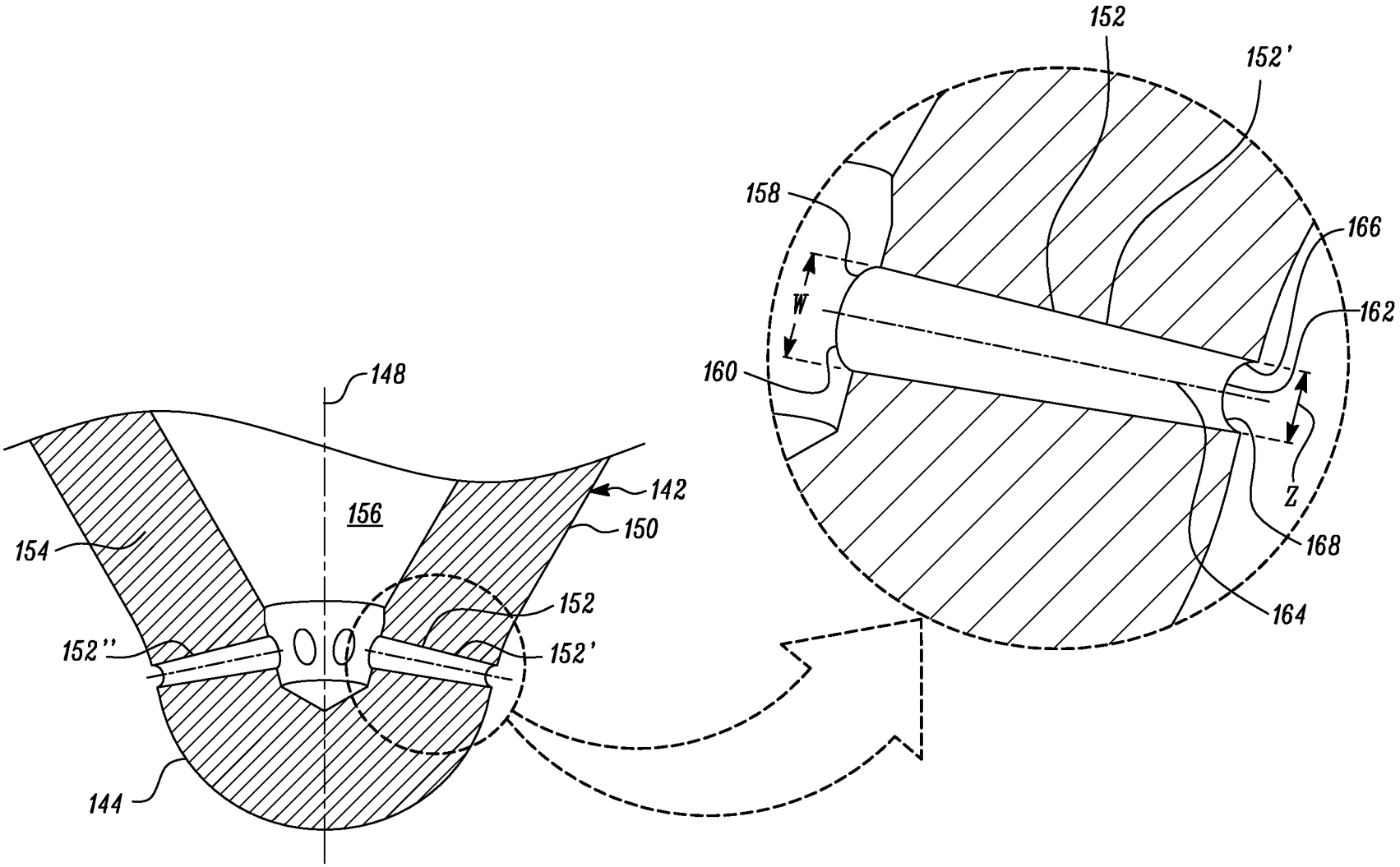
FIG. 2 is a sectional enlarged view of the fuel injector, depicting an orifice of the fuel injector, in accordance with an embodiment of the disclosure.

Referring to FIGS. 1 and 2, the fuel injector 142 includes a body 150 that defines a number of orifices (FIG. 2). The orifices may be categorized into a first orifice 152', and a plurality of second orifices 152" (best shown in FIG. 2). The orifices (i.e. both the first orifice 152' and the second orifices 152") may provide passage to the fuel into the combustion chamber 120 of the engine 100. For example, the orifices 152', 152" may be six in total. Nonetheless, a higher or a lower number of orifices 152', 152" may be contemplated. A passage of the fuel through the orifices 152', 152" facilitates a direct injection of the fuel into the combustion chamber 120 for combustion and subsequent power generation. A direct injection through the orifices 152', 152" may be in the form of a fan spray, according to one or more aspects of the present disclosure. Further, each orifice 152', 152" may be angled or canted relative to the longitudinal axis 148, thereby forming a substantially conical deployment/formation of the orifices 152', 152" in the body 150 of the fuel injector 142, at the tip 144. Such canting of the orifices 152', 152" may enhance an effectiveness of the fuel injection by enhancing spray-to-air interactions in the combustion chamber 120, while minimizing spray-to-spray interactions in the combustion chamber 120. In an embodiment, by canting to a suitable degree (such as up to 60 degrees for each orifice 152', 152"), relative to the longitudinal axis 148, fuel sprays from the orifices 152', 152" may flow past each other, mitigating spray overlaps in the combustion chamber 120. In some implementations, the orifices 152', 152" may be canted by more than 70 degrees relative to the longitudinal axis 148.

Although not limited, the orifices 152', 152" may be rotationally arrayed around the tip 144 of the fuel injector 142 (see FIG. 2), but it may be possible that the orifices 152', 152" are arranged according to a different, known pattern, or an irregular pattern, at or around the tip 144 of the fuel injector 142. Further, each orifice 152', 152" may extend into a thickness, t (see FIGS. 6 and 7), of a wall 154 of the body 150 of the fuel injector 142, at the tip 144 of the fuel injector 142 (see FIG. 2). In particular, the orifices 152', 152" may extend all the way across the wall 154, and be fluidly coupled to an inner chamber 156 of the fuel injector 142 (see exemplary depiction of the inner chamber 156 in FIG. 2). In that manner, the combustion chamber 120 may be fluidly coupled to the inner chamber 156 of the fuel injector 142 through said orifices 152', 152", so as to receive fuel from the inner chamber 156, during operations. Although the discussions above, in some implementations, the fuel injector 142 may include only a single orifice (i.e. the first orifice 152' alone).

Further description below discusses details pertaining to the orifices 152', 152", and such details may be discussed by way of referencing the first orifice 152' alone. It will be understood that the details discussed for the first orifice 152' may be applicable to second orifices 152", as well. Nevertheless, in some embodiments, it is possible that details discussed for the first orifice 152' are limited to the first orifice 152' itself, and/or to only a certain number of the second orifices 152". For ease in referencing and understanding, the first orifice 152' may be simply and interchangeably referred to as orifice 152, hereinafter. Wherever required, however, references to the first orifice 152' and the second orifices 152", by name and specific numeral callouts, such as 152' and 152", may also be used.

With continued reference to FIG. 2, a sectional view of the tip 144 of the fuel injector 142 is shown, and this sectional view also discloses cross-sections of two symmetrically formed orifices in the wall 154 of the body 150 of the fuel injector 142. For instance, the two symmetrically formed orifices may include the first orifice 152' and one of the second orifices 152", discussed above, and which may be defined along a common plane. Since the present disclosure may refer to only the first orifice 152' for detailed discussions, with the details of this first orifice 152' being applicable to one or more of the second orifices 152", only the first orifice 152' (as orifice 152) is annotated in detail.

The orifice 152 may include an inlet port 160 and an outlet port 162. The inlet port 160 may be configured to receive fuel from the inner chamber 156 of the fuel injector 142, while the outlet port 162 may be configured to provide an exit to the fuel received through the inlet port 160 into the combustion chamber 120, for fuel injection into the combustion chamber 120. Further, the orifice 152 includes a linear profile and defines an axis 164, referred to as a linear axis 164. In one embodiment, the linear axis 164 of the orifice 152 may be inclined to the longitudinal axis 148 of the fuel injector 142. Particularly, the inclination may be defined by the outlet port 162 of the orifice 152 being tilted towards the piston 130 (see FIGS. 1 and 2 in conjunction), with the linear axis 164 of the orifice 152 making an acute angle with the longitudinal axis 148—see orientations of the orifice 152 provided in FIG. 2. In one example, the acute angle may take a value between 30 degrees and 60 degrees. In some implementations, and as may be understood by the depicted embodiment in FIG. 2, the linear axis 164 of the orifice 152 and the longitudinal axis 148 may lie in a common plane. In yet some other embodiments, the fuel injector 142 may include only a single orifice, as the first orifice 152', for example, and in such a case, the linear axis 164 may be in line or may be parallel with the longitudinal axis 148.

Referring to FIGS. 2, 3, 4, and 5, according to some aspects of the present disclosure, the inlet port 160 includes a first oval shape 158, while the outlet port 162 includes a second oval shape 168. In further detail, the outlet port 162 may be defined at an axial end 166 of the orifice 152, and from this axial end 166 (i.e. along direction, A, see FIGS. 3 and 4), the second oval shape 168 is rotated relative to the first oval shape 158. More particularly, a major outlet axis 172 of the second oval shape 168 may be tilted relative to a major inlet axis 170 of the first oval shape 158, from the axial end 166, along the direction, A. According to one implementation, the tilt of the second oval shape 168 relative to the first oval shape 158 may correspond to the second oval shape 168 being orthogonal to the first oval shape 158, or that the tilt of the major outlet axis 172 of the second oval shape 168 is defined at a right angle relative to the major inlet axis 170 of the first oval shape 158, from the axial end 166. Accordingly, it may be noted that the major outlet axis 172 of the second oval shape 168 at the outlet port 162 may fall in line with (or be parallel to) a minor inlet axis 174 of the first oval shape 158 at the inlet port 160, from the axial end 166. Similarly, a minor outlet axis 176 of the second oval shape 168 at the outlet port 162 may fall in line with (or be parallel to) the major inlet axis 170 of the first oval shape 158 at the inlet port 160, from the axial end 166.

In one implementation, the major outlet axis 172 of the second oval shape 168 at the outlet port 162 is dimensionally smaller than the minor inlet axis 174 of the first oval shape 158 at the inlet port 160. In one implementation, and according to an aspect of the present disclosure, the orifice 152 has a larger cross-sectional area at the inlet port 160, with the first oval shape 158, than at the outlet port 162, with the second oval shape 168. Effectively, the inlet port 160 has a larger area compared to the outlet port 162.

Figure 3:
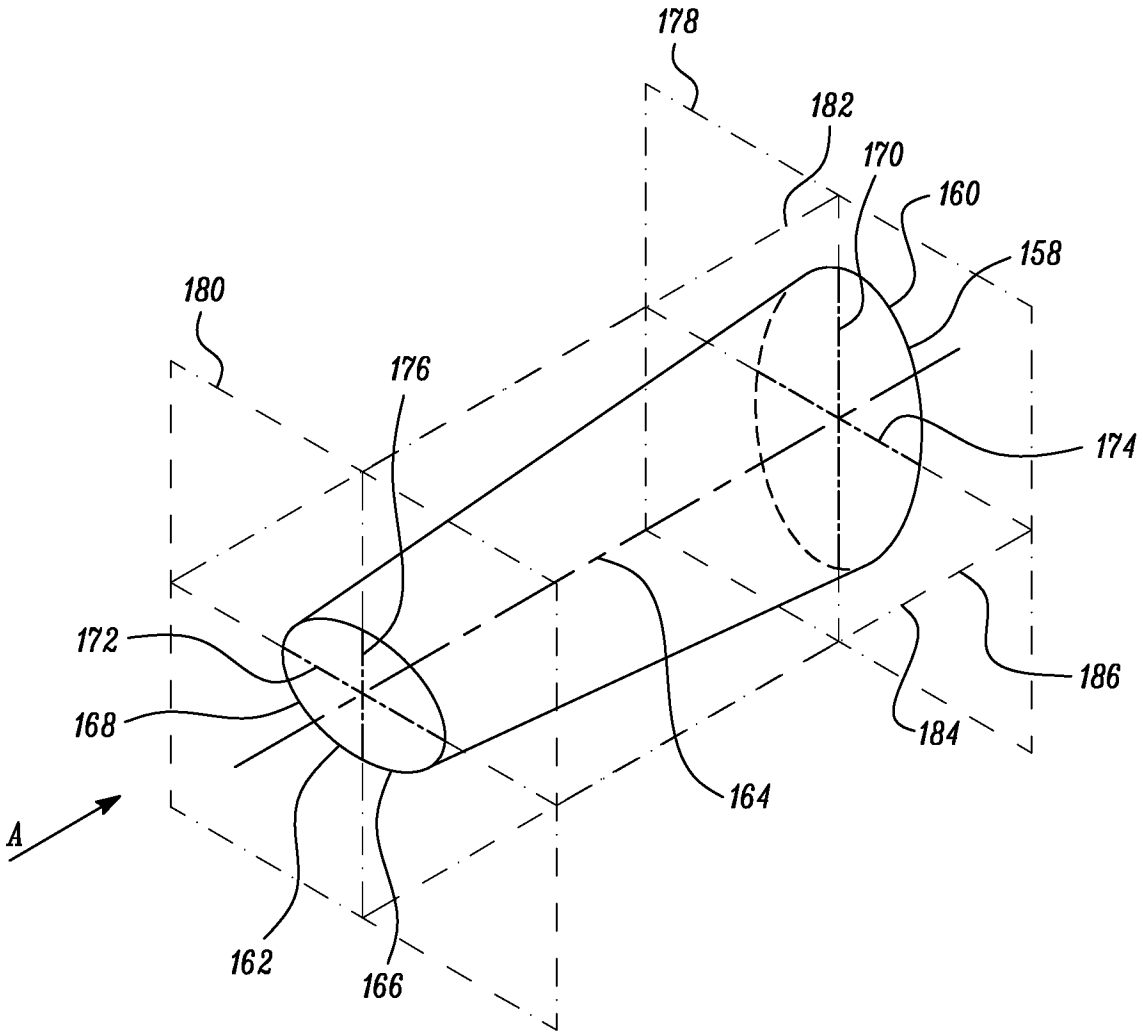
FIGS. 3 and 4 are different views of a profile of the orifice of the fuel injector, in accordance with an embodiment of the disclosure.
Figure 4:
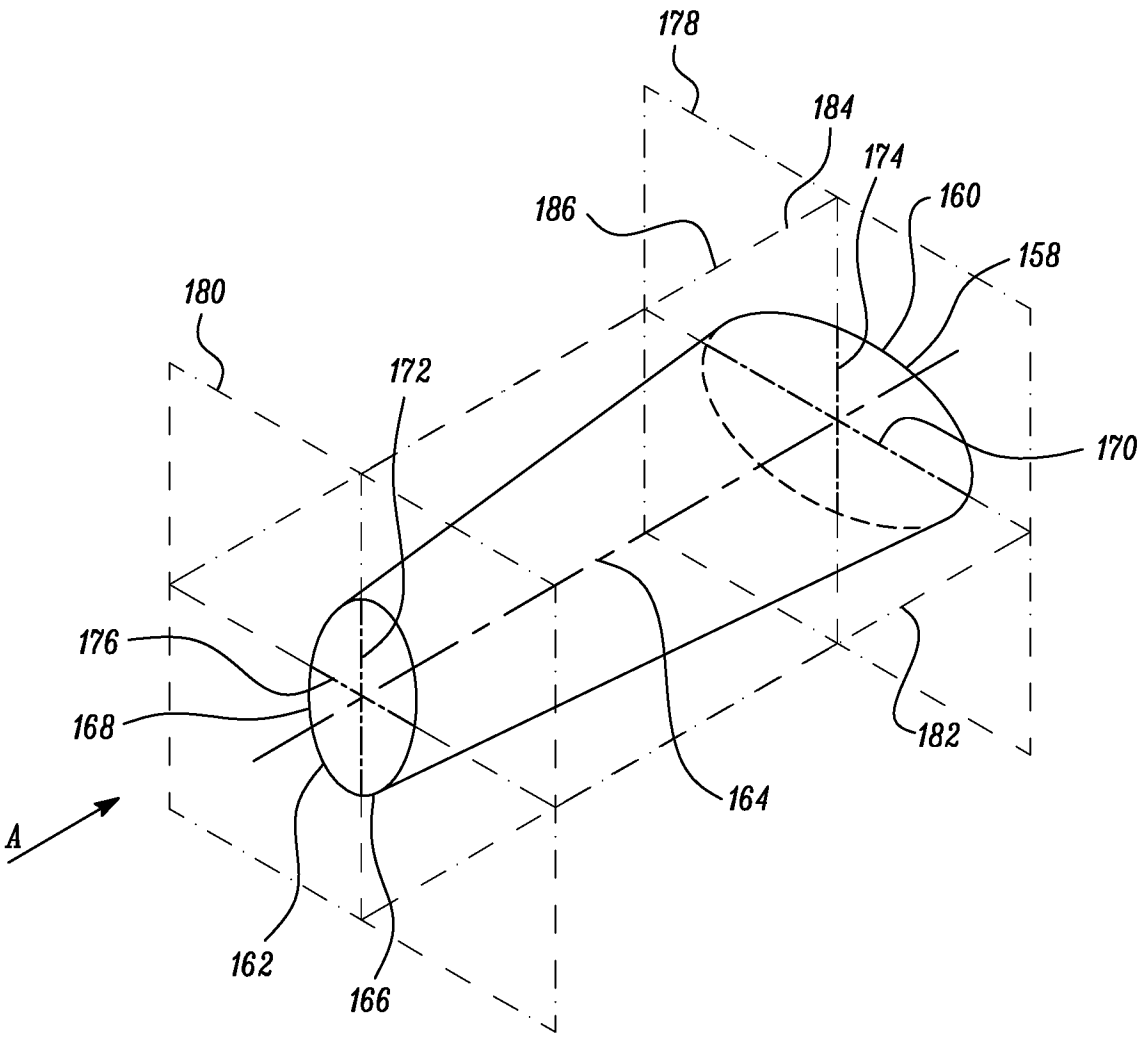

Further, as shown in FIGS. 3 and 4, the first oval shape 158 and the second oval shape 168 may be respectively and planarly defined along a first plane 178 and a second plane 180. The first plane 178 may be parallel to the second plane 180, although it is possible for the first plane 178 to be tilted relative to the second plane 180 in some cases. Also, in some cases, the linear axis 164 of the orifice 152 may be perpendicular to the first plane 178 and the second plane 180. In some cases, however, it is possible that one or both of the first oval shape 158 and the second oval shape 168 may be defined along a curved plane. Moreover, a third plane 182 may be defined as a common plane that is defined by the major inlet axis 170 of the first oval shape 158 at the inlet port 160, and the minor outlet axis 176 of the second oval shape 168 at the outlet port 162.

Furthermore, the orifice 152 may define a transition that extends between the first oval shape 158 at the inlet port 160 and the second oval shape 168 at the outlet port 162. The transition from the first oval shape 158 to the second oval shape 168 may be defined along the linear axis 164. Such a transition defines a stagnation plane 184 that facilitates an exit of the fuel from the fuel injector 142 as a fan spray from the outlet port 162. Notably, the stagnation plane 184 is defined about a fourth plane 186 defined by the major outlet axis 172 of the second oval shape 168 at the outlet port 162, and the minor inlet axis 174 of the first oval shape 158 at the inlet port 160. Accordingly, the stagnation plane 184 may pass through and lie along the linear axis 164 of the orifice 152, and be in line with the major outlet axis 172 of the second oval shape 168 at the outlet port 162. Given the orthogonal orientation of the first oval shape 158 relative to the second oval shape 168, the stagnation plane 184 may also be in line with the minor inlet axis 174 of the first oval shape 158 at the inlet port 160 (also see FIG. 5).

It may be understood that the stagnation plane 184 is defined by a convergence (i.e. a convergent transition) of the orifice 152 from the larger major inlet axis 170 of the first oval shape 158 at the inlet port 160 to the relatively smaller minor outlet axis 176 of the second oval shape 168 at the outlet port 162, and by a substantially non-convergent transition of the orifice 152 from the minor inlet axis 174 of the first oval shape 158 at the inlet port 160 to the major outlet axis 172 of the second oval shape 168 at the outlet port 162. Said convergent transition may be best understood by envisioning the transition of the orifice along the third plane 182, a depiction which is provided in FIG. 6, while said substantially non-convergent transition may be best understood by envisioning the transition of the orifice 152 along the fourth plane 186, a depiction which is provided in FIG. 7.

Figure 5:
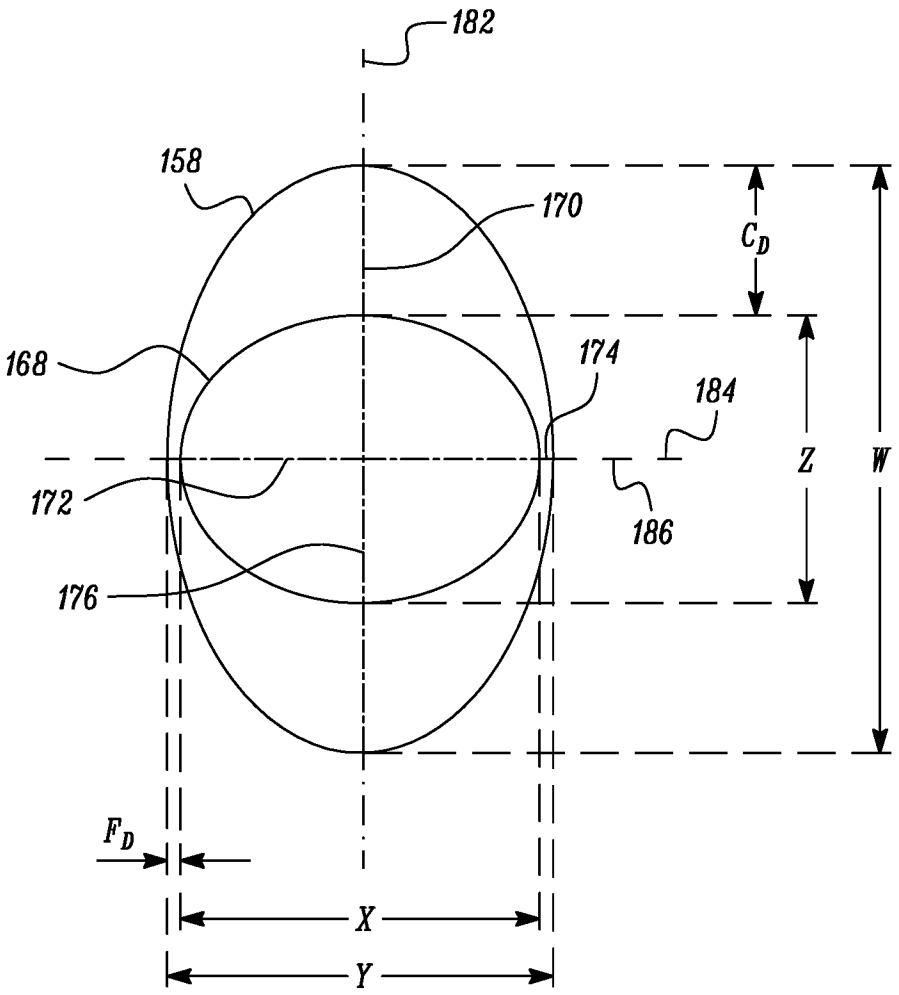
FIG. 5 is a view of the orifice from an axial end of the orifice, in accordance with an embodiment of the disclosure.
Figure 6:
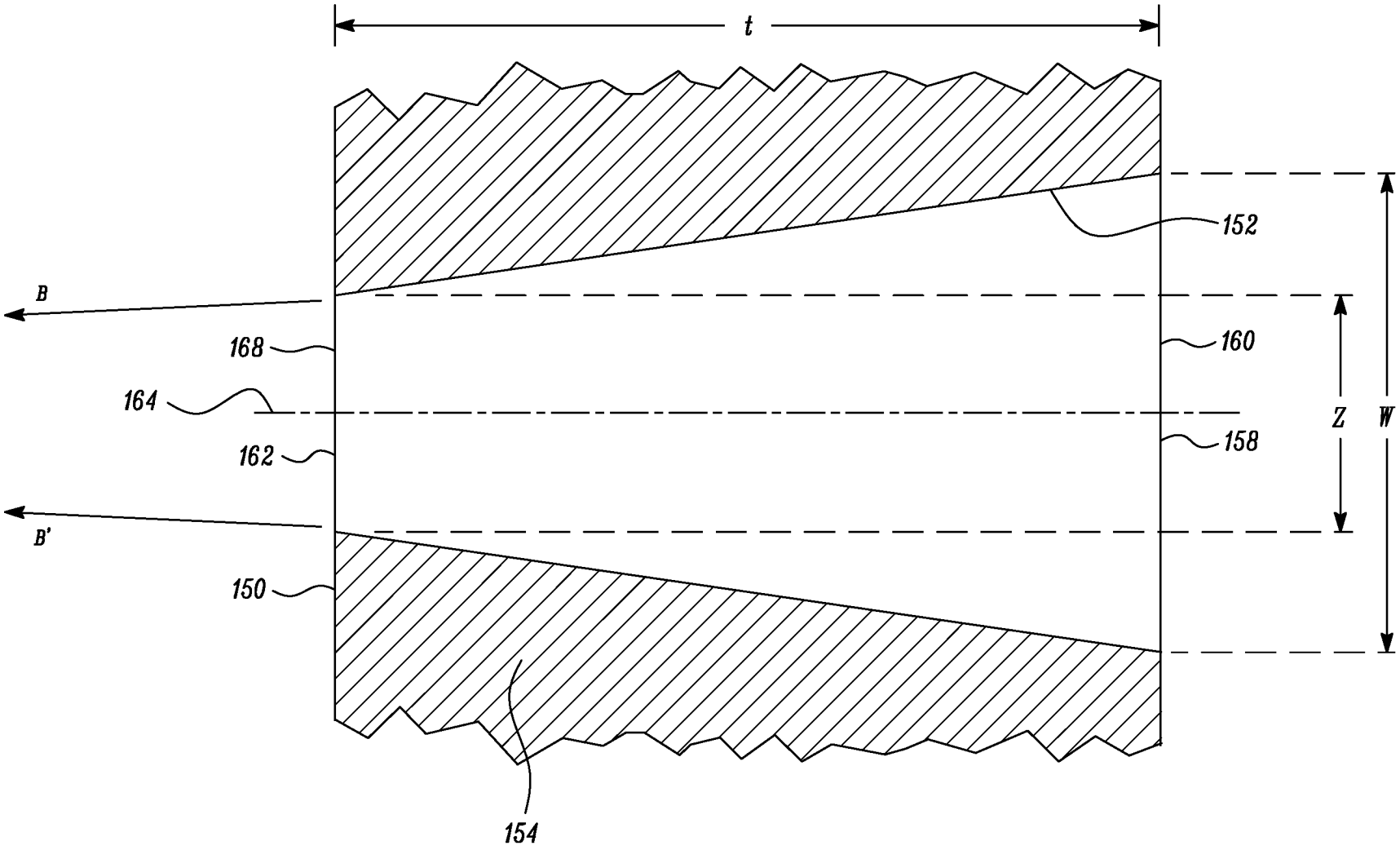
FIGS. 6 and 7, are different views illustrating an operational characteristic of the fuel injector, as a fuel exits the orifice of the fuel injector, in accordance with an embodiment of the disclosure.

Referring to FIGS. 5 and 6, the term "convergent transition" means that a dimension of the minor outlet axis 176 (annotated as 'Z') of the second oval shape 168 at the outlet port 162 may differ, or rather be smaller, relative to a dimension of the major inlet axis 170 (annotated as 'W') of the first oval shape 158 at the inlet port 160—see FIG. 5 to visualize this difference, annotated as '$C_D$', existing between the dimensions of the minor outlet axis 176 and the major inlet axis 170. Such convergence of the orifice 152 from the larger major inlet axis 170 of the first oval shape 158 at the inlet port 160 to the relatively smaller minor outlet axis 176 of the second oval shape 168 at the outlet port 162, may imply that 'W' is greater in dimension than 'Z'.

Figure 7:
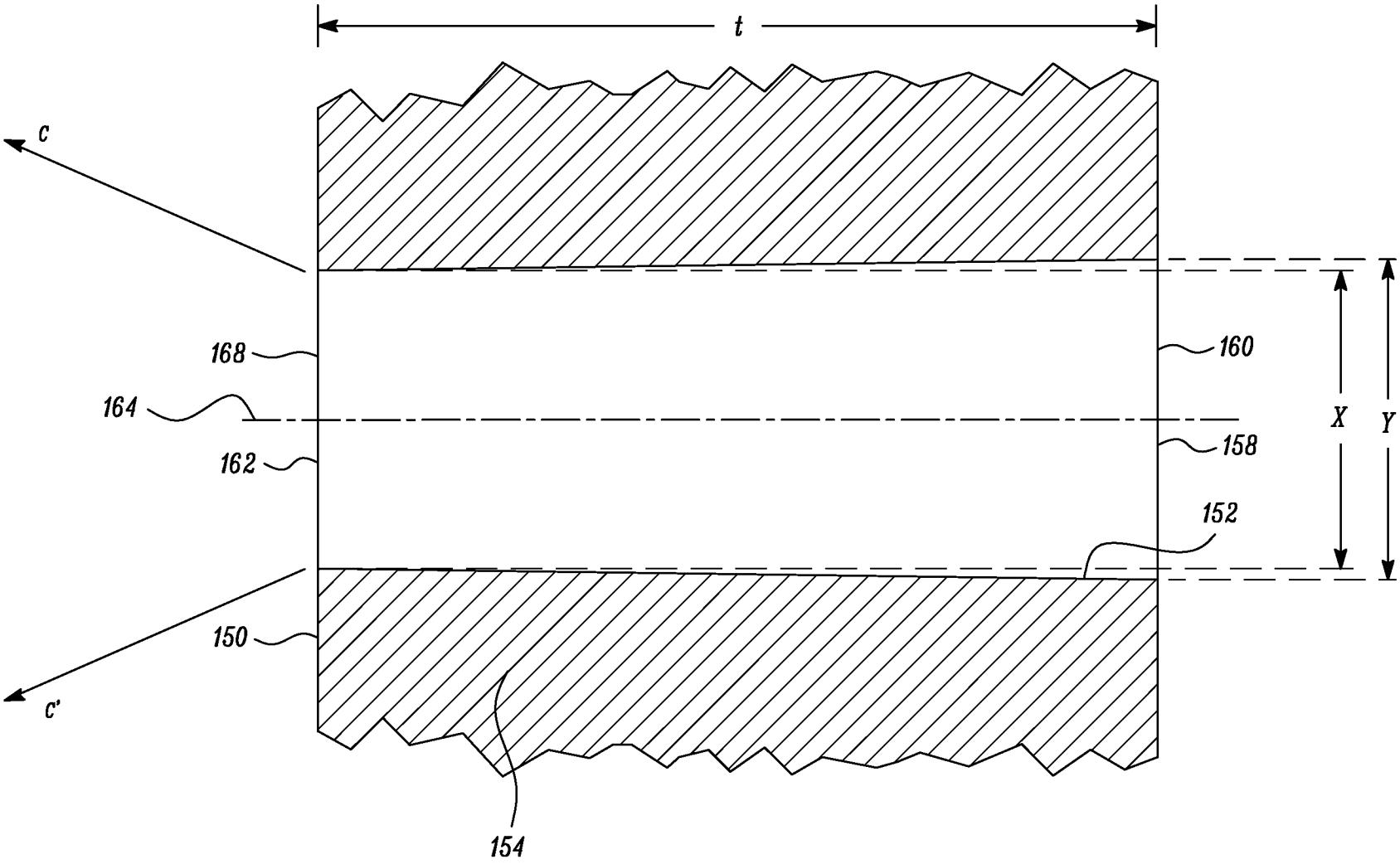

Referring to FIGS. 5 and 7, the term "substantially non-convergent transition" means that a dimension of the major outlet axis 172 (annotated as 'X') of the second oval shape 168 at the outlet port 162 may be either same as, or may have a fractional variation/difference relative to a dimension of the minor inlet axis 174 (annotated as 'Y') of the first oval shape 158 at the inlet port 160. The fractional variation/difference, for example, may be in millimeters (mm)—see FIG. 5 to visualize this fractional variation/difference, annotated as '$F_D$', existing between the dimensions of the major outlet axis 172 of the second oval shape 168 at the outlet port 162, and of the minor inlet axis 174 of the first oval shape 158 at the inlet port 160. Although not limited, 'Y' may be greater in dimension than 'X'.

Referring to FIGS. 6 and 7, a side cross-sectional view and a top cross-sectional view of the orifice 152 are respectively provided. More particularly, these views illustrate a characteristic spray pattern of the fuel, as the fuel exits the orifice 152 during operation. Arrows B-B' (FIG. 6) depict an exemplary thickness of the fan spray from the side view, as the fuel exits the outlet port 162 of the orifice 152, while arrows C-C' (FIG. 7) depict a wide-angle profile of the fan spray from the top view, as the fuel exits the outlet port 162 of the orifice 152. It may be noted that the thickness of the fan spray and the wide-angle profile of the fan spray may be dependent upon a pressure with which the fuel is injected by the fuel injector 142 into the combustion chamber 120. Also, by way of the depictions, annotated dimensions of the major inlet axis 170, major outlet axis 172, minor inlet axis 174, and minor outlet axis 176, are respectively provided as W, X, Y, and Z.

INDUSTRIAL APPLICABILITY

Referring to FIGS. 6 and 7, during operations, the fuel injector 142 facilitates a pressurization of a quantity of fuel for an injection into the combustion chamber 120 of the engine 100. During an injection event, the pressurized fuel enters the orifice 152 through the inlet port 160 (that has the first oval shape 158) and flows into the orifice 152, following a profile of the orifice 152. As a result, a flow of the fuel transitions according to the transition provided for the orifice 152. According to one exemplary passage of fuel through the orifice 152, an amount of fuel may execute a convergent flow along the third plane 182 (FIG. 6) from the inlet port 160 to the outlet port 162, while also executing the substantially non-convergent flow along the fourth plane 186 (FIG. 7). The portion of fuel executing the convergent flow causes a stagnation of fuel at the stagnation plane 184 (i.e. at the fourth plane 186). As a result, as this portion of fuel reaches the outlet port 162, a momentum of this portion of fuel converts to pressure, reducing a velocity of the fuel at the stagnation plane 184 to a minimum, in turn facilitating an exit of the fuel through the outlet port as a fan spray (see FIG. 7). The thickness of the fan spray exiting the outlet port 162, becomes smaller along a direction of the fan spray exiting the outlet port 162 (see arrows B-B', FIG. 6).

A fan spray created according to the aspects of the present disclosure mitigates the chances of fuel interacting excessively with the cylinder wall (or a liner wall 136 available within the cylinder 104). This is because, unlike a low angle conical spray (or unlike a pencil-shaped fuel spray pattern), the fan spray diffuses early (i.e. at a relatively short distance), and thus penetrates relatively less into the combustion chamber 120, reducing an interaction of the fuel with the cylinder wall (or the liner wall 136), thereby also mitigating the chances of degrading a lubricant that may be present on such walls. In particular, the wide-angle profile of the fan spray increases the chances of the fuel mixing with the air and the elements present within the combustion chamber 120, facilitating the early diffusion of fuel, and in turn facilitating easier and more effective combustion.

It will be apparent to those skilled in the art that various modifications and variations can be made to the system of the present disclosure without departing from the scope of the disclosure. Other embodiments will be apparent to those skilled in the art from consideration of the specification and practice of the system disclosed herein. It is intended that the specification and examples be considered as exemplary only, with a true scope of the disclosure being indicated by the following claims and their equivalent.

What is claimed is:

1. A fuel injector for an internal combustion engine, the fuel injector comprising:

a body defining an orifice configured to provide passage to a fuel into a combustion chamber of the internal combustion engine, the orifice including:

an inlet port having a first ellipse shape; and an outlet port having a second ellipse shape orthogonal to the first ellipse shape, wherein a transition from the first ellipse shape to the second ellipse shape defines a stagnation plane, the stagnation plane running through a center of the first ellipse shape of the inlet port and a center of the second ellipse shape of the outlet port and facilitating an exit of the fuel as a fan spray from the outlet port, wherein a center axis of the orifice is linear and runs through the center of the first ellipse shape of the inlet port and the center of the second ellipse shape of the outlet port, wherein the first ellipse shape and the second ellipse shape are respectively and planarly defined along a first plane and a second plane, wherein the orifice defines the center axis, the center axis being perpendicular to the first plane and the second plane, and wherein the orifice has a first cross-sectional area defined by the first ellipse shape of the inlet port greater than a second cross-sectional area defined by the second ellipse shape of the outlet port.

2. The fuel injector of claim 1, wherein the transition from the first ellipse shape to the second ellipse shape is defined along the center axis.

3. The fuel injector of claim 1, wherein the orifice defines the center axis and an axial end, the second ellipse shape being orthogonal to the first ellipse shape from the axial end.

4. The fuel injector of claim 3, wherein the second ellipse shape being orthogonal to the first ellipse shape corresponds to a major inlet axis of the first ellipse shape being tilted at a right angle relative to a major outlet axis of the second ellipse shape, from the axial end.

5. The fuel injector of claim 1, wherein a minor axis of the first ellipse shape of the inlet port is greater than a major axis of the second ellipse shape of the outlet port.

6. The fuel injector of claim 1, wherein the first plane is parallel to the second plane.

7. The fuel injector of claim 1, wherein the orifice is a first orifice, the fuel injector including at least one second orifice, and wherein the first orifice and the at least one second orifice are tilted relative to a longitudinal axis of the fuel injector.

8. The fuel injector of claim 1, wherein the fan spray defines a thickness that reduces along a direction of the fan spray exiting the outlet port.

9. An internal combustion engine, comprising:

a combustion chamber defined between a flame deck surface of a cylinder head of the internal combustion engine and a piston crown of a piston disposed within a cylinder bore of the internal combustion engine; and a fuel injector configured to inject a fuel into the combustion chamber, the fuel injector including:

a body defining an orifice configured to provide passage to the fuel into the combustion chamber, the orifice including:

an inlet port having a first elliptical shape; and an outlet port having a second elliptical shape orthogonal to the first elliptical shape, wherein a transition from the first elliptical shape to the second elliptical shape defines a stagnation plane, the stagnation plane running through a center of the first elliptical shape of the inlet port and a center of the second elliptical shape of the outlet port and facilitating injection of the fuel as a fan spray into the combustion chamber from the outlet port, wherein a center axis defined by the orifice is linear and runs at all times through a center of the orifice and through the center of the first elliptical shape of the inlet port and the center of the second elliptical shape of the outlet port, wherein the first elliptical shape and the second elliptical shape are respectively and planarly defined along a first plane and a second plane, the center axis is perpendicular to the first plane and the second plane, and wherein the orifice has a first cross-sectional area defined by the first elliptical shape of the inlet port greater than a second cross-sectional area defined by the second elliptical shape of the outlet port.

10. The internal combustion engine of claim 9, wherein the transition from the first elliptical shape to the second elliptical shape is defined along the center axis.

11. The internal combustion engine of claim 9, wherein the orifice defines an axial end, the second elliptical shape being orthogonal to the first elliptical shape from the axial end, and wherein the second elliptical shape being orthogonal to the first elliptical shape corresponds to a major inlet axis of the first elliptical shape being tilted at a right angle relative to a major outlet axis of the second elliptical shape, from the axial end.

12. The internal combustion engine of claim 9, wherein the stagnation plane is defined by a major outlet axis of the second elliptical shape of the outlet port and a minor inlet axis of the first elliptical shape of the inlet port.

13. The internal combustion engine of claim 9, wherein a major axis of the outlet port is less than a minor axis of the inlet port.

14. The internal combustion engine of claim 9, wherein the first plane is parallel to the second plane.

15. The internal combustion engine of claim 9, wherein the orifice is a first orifice, the fuel injector including at least one second orifice, and wherein the first orifice and the at least one second orifice are tilted relative to a longitudinal axis of the fuel injector.

16. The internal combustion engine of claim 9, wherein the fan spray defines a thickness that reduces along a direction of the fan spray exiting the outlet port.

* * * * *